US010531706B2

(12) United States Patent
Alander

(10) Patent No.: US 10,531,706 B2
(45) Date of Patent: Jan. 14, 2020

(54) SHOE HEEL COVER AND KIT

(71) Applicant: Shoenique Designs, Inc., Thornhill (CA)

(72) Inventor: Melinda Alander, Thornhill (CA)

(73) Assignee: Shoenique Designs, Inc. (CA)

( * ) Notice: Subject to any disclaimer, the term of this patent is extended or adjusted under 35 U.S.C. 154(b) by 348 days.

(21) Appl. No.: 15/044,862

(22) Filed: Feb. 16, 2016

(65) Prior Publication Data

US 2016/0235163 A1 Aug. 18, 2016

Related U.S. Application Data

(60) Provisional application No. 62/116,174, filed on Feb. 13, 2015.

(51) Int. Cl.

| | |
|---|---|
| ***A43B 21/42*** | (2006.01) |
| ***A43B 21/433*** | (2006.01) |
| ***A43B 3/24*** | (2006.01) |
| ***A43B 21/47*** | (2006.01) |

(52) U.S. Cl.

CPC ..... *A43B 21/42* (2013.01); *A43B 3/24* (2013.01); *A43B 21/433* (2013.01); *A43B 21/47* (2013.01)

(58) Field of Classification Search

CPC ..... A43B 21/42; A43B 3/0078; A43B 21/433; A43B 3/24; A43B 21/48; A43B 21/47; A43B 21/36; A43B 3/246; A43C 11/12; A43C 19/00

USPC ..... 36/72 B, 42, 24.5, 36 R

See application file for complete search history.

(56) References Cited

U.S. PATENT DOCUMENTS

| | | | | | |
|---|---|---|---|---|---|
| 1,235,324 | A | | 7/1917 | Kimber | |
| 1,478,144 | A | * | 12/1923 | Riccioli | A43B 13/34 12/147 R |
| 1,949,940 | A | | 3/1934 | Monfils | |
| 1,957,462 | A | | 5/1934 | Kress | |
| 2,187,167 | A | | 1/1940 | Mayor | |
| 2,189,812 | A | | 1/1940 | McGill et al. | |
| 2,478,264 | A | | 8/1949 | Forrest et al. | |
| 2,556,842 | A | | 6/1951 | Gilmour | |
| 2,707,341 | A | * | 5/1955 | Romano | A43B 13/34 36/100 |
| 2,805,432 | A | | 9/1957 | Riggs | |
| 2,878,594 | A | | 9/1957 | Fitzsimmons | |
| 2,915,836 | A | | 12/1959 | McDonough | |
| 3,041,747 | A | * | 7/1962 | Pfeil | A43B 21/42 36/42 |
| 3,138,882 | A | | 6/1964 | Maya | |
| 3,154,866 | A | | 11/1964 | Laufbahn | |
| 3,174,234 | A | | 3/1965 | Weitzner | |
| 3,262,221 | A | | 7/1966 | Antelo | |
| 3,299,542 | A | | 1/1967 | Knut | |
| 3,305,948 | A | | 2/1967 | Ronci | |

(Continued)

*Primary Examiner* — Katharine Gracz

(74) *Attorney, Agent, or Firm* — Mark Malek; Paul J. Ditmyer; Widerman Malek, PL

(57) ABSTRACT

A shoe heel and heel cover system including a shoe post and a heel cover. The shoe post includes a polygonal main body, a ball, and a spring. The polygonal main body has a top and a bottom. The ball is located on the polygonal main body. The spring is positioned within the polygonal main body and behind the ball. The heel cover has an opening configured to matingly engage the ball and a polygonal void is formed through the heel cover. The heel cover slidably engages the shoe post.

15 Claims, 8 Drawing Sheets

35

(56) References Cited

U.S. PATENT DOCUMENTS

| | | | | |
|---|---|---|---|---|
| 3,325,918 | A | 6/1967 | Weitzner | |
| 3,514,879 | A | 6/1970 | Frattallone | |
| 3,797,136 | A | 3/1974 | Soleri | |
| 4,415,072 | A * | 11/1983 | Shoji | F16D 41/066 192/45.007 |
| 4,424,635 | A | 1/1984 | Jourdan | |
| 4,494,323 | A | 1/1985 | Latraverse | |
| 4,805,320 | A | 2/1989 | Goldenberg et al. | |
| 5,079,857 | A | 1/1992 | Clifton | |
| 5,133,138 | A | 7/1992 | Durcho | |
| 5,524,365 | A | 6/1996 | Goldenberg | |
| 5,675,916 | A | 10/1997 | Lewis | |
| 5,887,360 | A * | 3/1999 | Bucalo | A43B 3/24 36/100 |
| 5,953,836 | A | 9/1999 | Watt et al. | |
| 6,021,586 | A | 2/2000 | Bucalo et al. | |
| 6,023,858 | A | 2/2000 | Srourian | |
| 6,631,570 | B1 | 10/2003 | Walker | |
| 7,954,256 | B2 | 6/2011 | Colella | |
| 7,971,373 | B2 | 7/2011 | Epping | |
| 8,015,731 | B2 | 9/2011 | Jackson | |
| 8,132,341 | B1 | 3/2012 | Laramore | |
| 8,505,218 | B2 | 8/2013 | Anguilo et al. | |
| 8,925,218 | B2 | 1/2015 | Anderson | |
| 2001/0052195 | A1 | 12/2001 | Blakey | |
| 2002/0133980 | A1 * | 9/2002 | Pan | A43B 21/24 36/100 |
| 2003/0154629 | A1 | 8/2003 | Goodloe | |
| 2011/0067265 | A1 * | 3/2011 | Green | A43B 13/04 36/42 |
| 2012/0174435 | A1 | 7/2012 | Ruano Cerdan et al. | |
| 2012/0324764 | A1 | 12/2012 | Velez-Cruz | |
| 2013/0019498 | A1 | 1/2013 | Causey et al. | |
| 2013/0067770 | A1 | 3/2013 | Sherwood et al. | |
| 2013/0091734 | A1 | 4/2013 | Feller et al. | |

* cited by examiner

SHOE HEEL COVER AND KIT

RELATED APPLICATIONS

This application is related to and claims the benefit of U.S. Provisional Patent Application Ser. No. 62/116,174 filed on Feb. 13, 2015 and titled Shoe Heel and Heel Cover System, the entire contents of which are incorporated herein by reference, except to the extent that any disclosure therein conflicts with disclosure herein.

FIELD OF THE INVENTION

The present invention relates to systems and methods for customizing shoes and, more specifically, to the field of shoe accessories, decorations, and parts related to same.

BACKGROUND OF THE INVENTION

Shoes are often worn by people as a fashionable item. Because most shoes do not have interchangeable decorative aspects, it is necessary to purchase a multitude of shoes simply to have the desired number of fashionable looks. Often times, this includes different styles of shoes and shoes that may be less comfortable than others. Although some shoes have heels that are interchangeable, these heels only change the type of heel, for example from a two inch heel to a four inch heel. This does not change the decorative aspects of the shoe and the interchange is also cumbersome and difficult to do in many cases. In addition, the complicated components included in many of these devices and systems may be expensive and require additional time to produce and manufacture.

U.S. patent application Ser. No. 13/647,980 by Anderson discloses a high-heeled shoe that utilizes exchangeable high-heels. A biased, pivoting latch is formed into the sole of the shoe at the heel portion of the sole. A heel stem is fixedly attached to the shoe and extends from the sole terminating in a tip. The device, especially the hinge and latch design for engaging the heel cover to the heel stem, is complicated and does not allow a user to slide a heel cover off and on. Furthermore, the attachment location is through the bottom of the shoe not the heel post.

U.S. Pat. No. 7,971,373 to Epping discloses a support sleeve for high heels on ladies' shoes with a sleeve body to accommodate a heel. The sleeve body has a substantially larger base than the base of the heel. The sleeve body is held in place using a system of ribs or fins and a rigid plate. The system is complicated and requires an in depth knowledge of the system in order to change the heel.

U.S. Pat. No. 2,915,836 to McDonough discloses a covering for high heels of ladies shoes. The covering is supplied as a separate unit, to be slipped, clipped or otherwise attached to the high heels of ladies' shoes. This device has only color differences, not decorative and/or ornamental differences. The device only fits over existing heels and is meant to be used to cover existing damaged, scuffed, or otherwise unsightly heels with a new covering to put the shoe in a near original appearance.

U.S. Pat. No. 5,675,916 to Lewis discloses a shoe with an interchangeable heel. The heel can be interchangeably attached to the heel portion of the outside of the shoe by extending a large bolt through an opening on the rear portion of the outsole. In this device, the entire heel is interchangeable, not just an accessory, decoration, or other part of the heel. The system, like the system in the Epping reference, is complicated and requires an in depth knowledge of the system in order to change the heel. Further, the heel is not a permanent part of the shoe, which creates a less stable and less secure shoe.

U.S. Pat. No. 1,957,462 to Kress discloses an improved ratchet wrench having a ratchet wheel and a pawl with two teeth arranged so that when forces transmitted from the body member of the wrench through the pawl to the ratchet wheel may be substantially equally divided when the parts of the wrench are being subjected to strains corresponding with a normal working load. In addition, the ratchet wrench has a pawl that is shiftable from one position to another to reverse the wrench. As part of the ratchet wrench system, a socket is used which is engaged with the wrench via a ball and spring system. Although this ball and spring system has been used in wrench and socket systems, it has not been used as a portion of a shoe and has more specifically not been used to engage attachments or decorative features to shoes or heels of shoes.

The devices and systems described above, and other devices and systems that may be known in the art generally suffer from the same deficiency, i.e., the devices and systems do not have a shoe with a permanent or fixed heel or a detachable heel that allows for quick and easy transition of accessories, decorative aspects, or other parts that may be used in connection with the heel of a shoe. This means that if a person wants the features of the heel, such as the decorative aspects, to be changed, the heel must be removed entirely or a new shoe must be used. Removal of the entire heel takes time, knowledge of the device, and can cause additional wear to the shoe and specifically to the shoe heel and/or shoe post. The wear to the shoe can compromise the integrity and safety of the shoe. In addition, the present invention can be used in combination with the devices and systems described above. For example, and without limitation, the heel may be interchangeable, but once positioned on the shoe, the aspects of the present invention may be utilized to allow a person to add, remove, or otherwise change the accessories, decorations, or parts of the heel. Thus, the prior art fails to disclose ornamental or decorative heel covers such as those described by the present invention and the prior art further fails to disclose the method of attaching the heel covers described by the present invention.

SUMMARY OF THE INVENTION

In view of the foregoing, it is therefore an object of the present invention to provide a shoe heel cover and kit that gives a user the ability to quickly and easily change accessories, decorations, and/or parts of a shoe. Therefore, the embodiments of the present invention are related to a shoe heel cover and kit that may advantageously allow for a single pair of shoes to be worn that may be changed to have different looks, colors, features, accessories, decorations, etc. by securing different heel covers to a shoe post. The heel cover and kit according to an embodiment of the present invention may also advantageously overcome drawbacks in the prior art by saving users money and time since a user only needs one pair of shoes, but may interchange numerous decorative heel covers with that single pair of shoes.

With the above in mind, the present invention is directed to a shoe heel and heel cover system including a shoe post and a heel cover. The shoe post may have a polygonal main body, a ball, and a spring. The polygonal main body may have a top and a bottom. The ball may be located on the polygonal main body. The spring may be positioned within the polygonal main body and behind the ball. The heel cover may have an opening configured to matingly engage the ball.

A polygonal void may be formed through the heel cover. The heel cover may slidably engage the shoe post.

The ball may be moveable between an engaged position and a disengaged position. The disengaged position may be defined as the spring being compressed so that the ball is depressed into the polygonal main body. The engaged position may be defined as the spring being at rest so that the ball protrudes from the polygonal main body.

When the heel cover slidably engages the shoe post, the heel cover may be configured to place a force on the ball to move the ball from the engaged position to the disengaged position.

The ball may be configured to align with and matingly engage the opening when the ball and opening align.

The spring may be moveable between a compressed position and a decompressed position. The compressed position may be defined as the spring being compressed by a force exerted on the ball and moving the ball to the disengaged position. The decompressed position may be defined as the spring being extended to position the ball in the engaged position. The spring may be configured to move from the compressed position to the decompressed position.

The heel cover and shoe post may matingly engage when the ball is positioned within the opening.

The heel cover may be configured to disengage and slide off of the shoe post when the ball moves from the engaged position to the disengaged position.

The shoe post may further include a male threaded upper end configured to be received by a threaded female passageway on a shoe.

The shoe post may further include a plurality of balls located on the main body, which may be configured to matingly engage with a corresponding plurality of openings on the heel cover.

The shoe post may further include a threaded female passageway configured to engage a male threaded member that extends downwardly from a shoe bottom.

The heel cover may be configured to be removable and interchangeable with a plurality of similarly structured heel covers.

The plurality of similarly structured heel covers may be uniquely decorated.

The shoe heel cover may include an elongate member having a polygonally shaped void passing therethrough and sized to receive a polygonally shaped shoe heel post. The elongate member may be configured to secure to the polygonal shoe heel post.

An opening may be formed in the elongate member. The shoe heel post may have a spring located within a main body behind a ball. The ball may be moveable between an engaged position and a disengaged position. The disengaged position may be defined as the spring being compressed so that the ball is depressed into the polygonal main body. The engaged position may be defined as the spring being at rest so that the ball protrudes from the polygonal main body. The ball may be configured to move to the disengaged position when force is applied thereto and configured move to the engaged position and matingly engage the opening when the force has terminated.

Slidably engaging the void on the elongate member with the shoe heel post may cause the ball to be moved from the engaged position to the disengaged position.

The ball may be configured to move from the disengaged position to the engaged position when aligned with the opening of the heel cover and wherein the ball is adapted to secure the elongate member to the shoe heel post with a friction fit when in the engaged position.

The shoe heel post may have a male threaded member adapted to be received by a threaded female passageway located on a shoe bottom.

The shoe heel post may be configured to rotate from a first position relative to the shoe bottom and settle into a different aesthetic orientation in a second position.

The heel cover may be configured to rotate with the shoe heel post from a first position relative to the shoe bottom and settle into a different aesthetic orientation in a second position.

A heel cover kit may include a shoe, a shoe heel post, and an elongate member. The shoe may have a threaded female passageway located within a shoe bottom. The threaded female passageway may be configured to receive a male threaded upper end. The shoe heel post may include a body portion that has a polygonal shape and include a first end, second end, recess, and ball. There may be a plurality of planar surfaces between the first end and second end. The male threaded upper end may extend from the top. The recess may be located in at least one of the plurality of planar surfaces. The ball may be moveable between an engaged position and a disengaged position. The disengaged position may be defined as the ball being depressed into the body portion. The engaged position may be defined as the ball protruding from the main body. The elongate member may have a polygonal void shaped therethrough, which may be adapted to receive the shoe heel post. The elongate member may have an opening configured to matingly receive the ball. The opening and the ball may be configured to align and secure the elongate member to the shoe heel post with a friction fit. The elongate member may be configured to be removable and interchangeable with a plurality of similarly structured elongate members.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Further, throughout this specification, the invention is referred to as a heel cover and kit. Throughout this disclosure, the heel cover and kit may be referred to as the system, the device(s), the apparatus, or the invention. Alternate references to the heel cover and kit in this disclosure are not meant to be limiting in any way. By way of example, heel cover and elongate member may at times be used interchangeably. The present invention is also not meant to be limited to use in connection with high heel shoes. Those skilled in the shoe field will appreciate that the present invention can advantageously be used in connection with any type of men's shoes or other types of women's shoes.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

Figure 1:
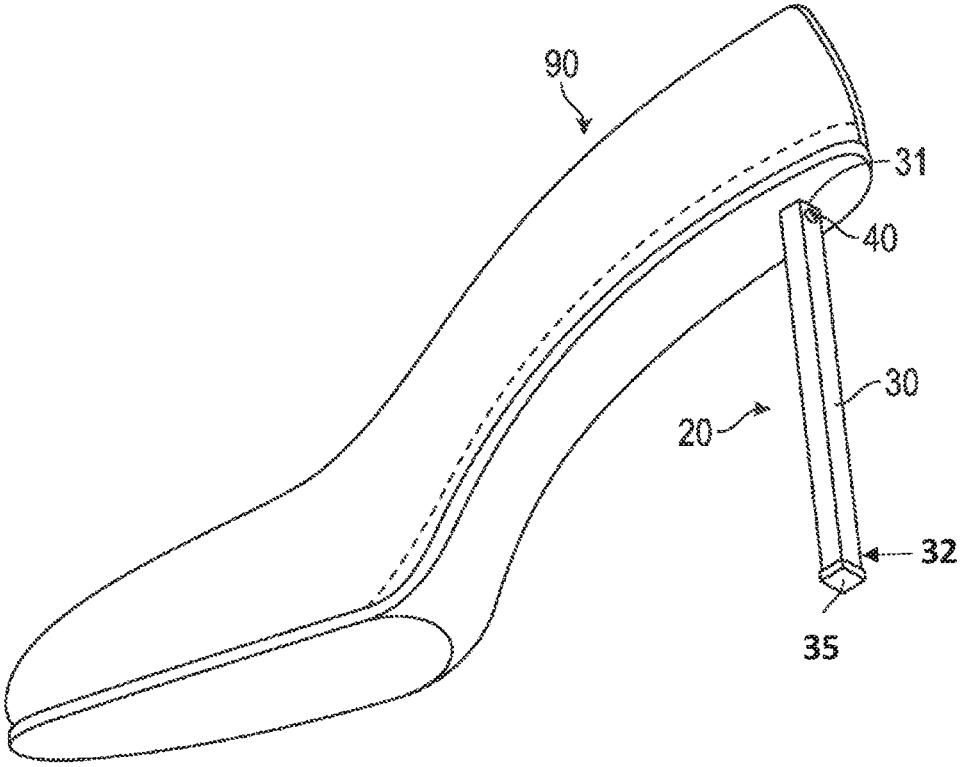
FIG. 1 is a side perspective view of a shoe system including a shoe post according to an embodiment the present invention.
Figure 2:
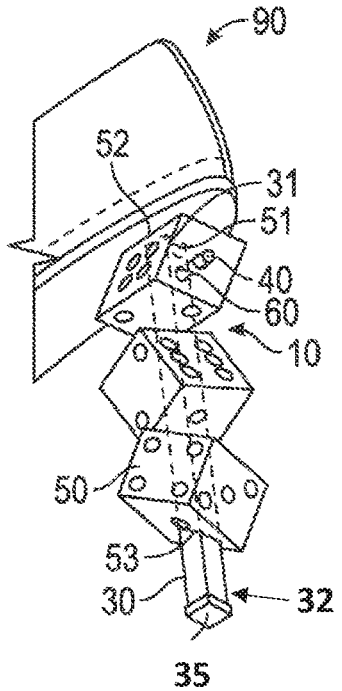
FIG. 2 is a partial side perspective view of the shoe system, including a heel cover, according to one embodiment of the invention.
Figure 3:
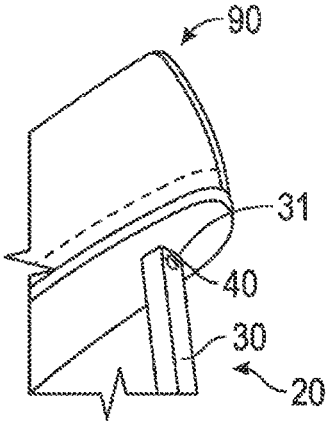
FIG. 3 is a partial side perspective view of a portion of the shoe system as illustrated in FIG. 1.
Figure 4:
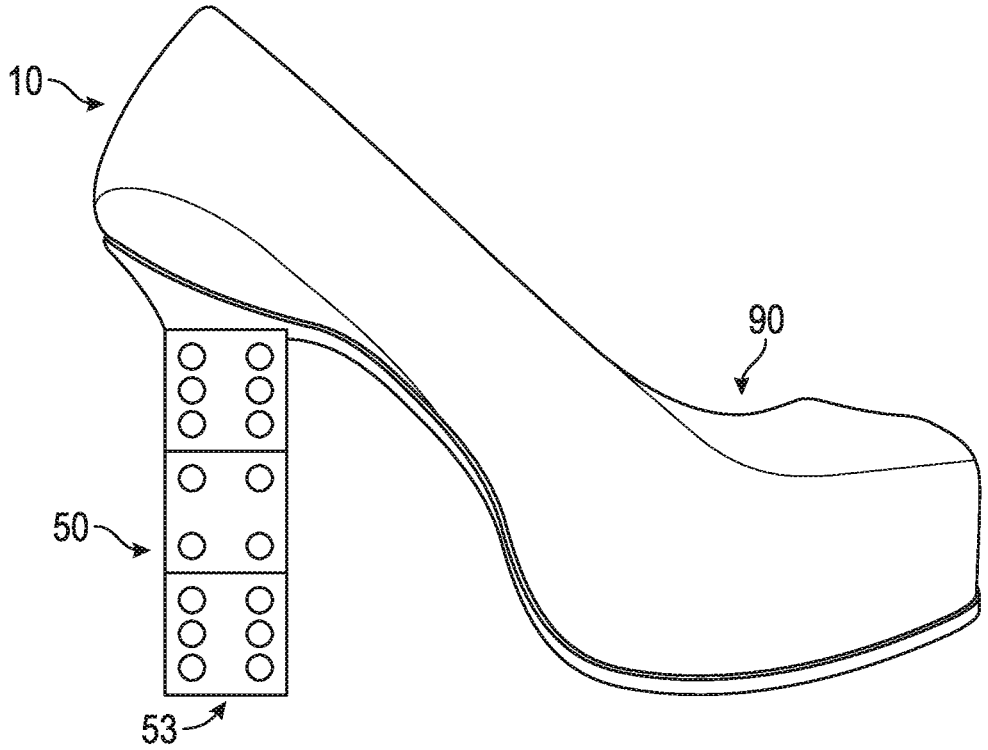
FIG. 4 is a side view of a shoe system having a shoe, a shoe post, and a heel cover according to an embodiment of the present invention.

Referring now to FIGS. 1-3, details of the shoe heel cover and kit 10 according to an embodiment of the present invention are now discussed in greater detail. The shoe heel cover and kit 10 may include a polygonal shoe post 20, a shoe 90, and a heel cover 50. The polygonal shoe post 20 may include a main body 30 and the main body 30 may include a first end 31 and a second end 32.

The main body 30 may also include a ball 40. The main body 30 may have a polygonal shape. A plurality of planar surface may connect a top 31 of the main body 30 to a bottom 32 of the main body 30. A spring 70 may be positioned within the main body 30 and behind the ball 40. The ball 40 may be located in a recess 80 located on the main body 30. The ball 40 may be a spherical or other shaped object, including, but not limited to, a button, adapted to move between a disengaged position within the main body 30 and an engaged position extending beyond the main body 30. The disengaged position may be defined as the spring 70 being compressed so that the ball is depressed into the polygonal main body. The engaged position may be defined as the spring 70 being at rest so that the ball 40 protrudes from the polygonal main body. The spring 70 may be moveable between a compressed position when the ball 40 is in the disengaged position and a decompressed position when the ball 40 is in the engaged position. The compressed position may be defined as the spring 70 being compressed by a force exerted on the ball 40 or the spring 70 and moving the ball to the disengaged position. The decompressed position may be defined as the spring 70 being extended to position the ball 40 in the engaged position. The spring 70 may be configured to move from the compressed position to the decompressed position.

The shoe post 20 may have a male threaded upper end 33 on the top 31 of the main body 30. The male threaded upper end 33 may be configured to be received by a threaded female passageway 91 located on a bottom side of a shoe 90. The connection between these threaded components may secure the shoe post 20 to the shoe 90.

The heel cover 50 may slide over the polygonal shoe post 20 and may matingly engage the ball 40. In this manner, the heel cover 50 may be engaged with the polygonal shoe post 20. The heel cover 50 may also disengage from the ball 40 and may slide off the polygonal shoe post 20. This allows the polygonal shoe post 20 to attach to a plethora of heel covers 50. The heel cover 50 may be configured to be removeable and interchangeable with a plurality of similarly structure heel covers 50. The similarly structured heel covers 50 may have interior passageways 51 and an opening 60 configured to secure to the shoe post 20. The plurality of similarly structured heel covers may be uniquely decorated. The unique decorations of the plurality of similarly structured heel covers 50 may include, but is not limited to, indicia, patterns, sculpture, or the like located on an external surface of the heel cover 50.

The heel cover 50 may have a hollowed interior polygonal void or passageway 51 that runs the interior length of the heel cover 50. The shape and number of sides of the polygonal void 51 may match the shape and number of sides of the polygonal shoe post 20. This allows the polygonal shoe post 20 to slide inside the polygonal void 51 while preventing rotation of the heel cover 50 relative to the polygonal shoe post 20. A top portion 52 of the heel cover 50 may have a cross-sectioned first opening for the polygonal void 51. A bottom portion 53 of the heel cover 50 may have a cross sectioned second opening for the polygonal void 51. The top portion 52 may matingly engage the first end 31 of the main body 30. The bottom portion 53 may matingly engage the second end 32 of the main body 30. The top portion 52 may have a larger inner perimeter than the inner perimeter of the bottom portion 53. The bottom portion 53 may have a larger inner perimeter than the inner perimeter of the top portion 52. The polygonal void 51 may taper at any point along the distance of the polygonal void 51. For example, and without limitation, the void may taper from the top portion 52 to the bottom portion 53 or from the bottom portion 53 to the top portion 52. Those skilled in the art will appreciate that when the heel cover 50 is matingly engaged with the polygonal shoe post 20, the polygonal void 51 may be all, substantially, or partly filled with the polygonal shoe post 20. In the embodiment of the shoe heel cover and kit 10 illustrated in the appended figures, the polygonal void 51 is illustrated as being polygonal and the shape of the main body 30 is also illustrated as being polygonal. Those skilled in the art, however, will appreciate that the main body 30 and the polygonal void 51 may have any shape that corresponds to each other. For example, the main body 30 may have an ovular shape, and the polygonal void 51 may have a corresponding ovular shape that has an inner diameter or circumference that is slightly larger than the circumference or diameter of the main body.

The heel cover 50 may include an elongate member. A polygonally shaped void or passageway 50 may pass through the elongate member. The polygonally shaped void 50 may be sized to receive a corresponding polygonally shaped shoe heel post 20. The elongate member may be configured to secure to the polygonal shoe heel post 20.

An aperture 21 may be formed in the shoe post 20. A ball 40 may be carried by the aperture 21 and placed in front of a spring 70 located in the shoe post 20. The ball 40 may be moveable between an engaged position and a disengaged position. The disengaged position may be defined as the spring 70 being compressed so that the ball 40 is depressed into a recess 80 within the shoe post 20. The engaged position may be defined as the spring 70 being decompressed so that at least a portion of the ball 40 protrudes past an exterior surface of the shoe post 20. The ball 40 may be configured to move to the disengaged position when force is applied thereto and configured move to the engaged position and matingly engage the opening of the heel cover 50 when the force has terminated. The ball 40 may be configured to move from the disengaged position to the engaged position when aligned with the opening 60 of the shoe heel cover 50. The ball 40 may be adapted to secure the elongate member to the polygonally shaped shoe heel post 20 with a friction fit when in the engaged position.

The shoe heel cover and kit 10 may be preferably used with high heel shoes, including, but not limited to, stilettos, pumps, wedges, peep toes, booties, knee high boots, thigh high boots, and sandals. The first end 31 of the main body 30 may be attached to the sole or bottom of the shoe. The main body 30 may include the ball 40 near the first end 31. Additionally, the main body 30 may include a plurality of balls 40 near the first end 31, near the second end 32, or at any location on the main body 30. The heel cover 50 may include an opening 60 or a plurality of openings 60 that matingly engage with the ball 40. The ball 40 may be positioned in front of a spring 70. The spring 70 may be positioned within a recess 80 located within the polygonal shoe post 20 and behind the ball 40. When the heel cover 50 slides over the polygonal shoe post 20 and reaches the ball 40, the force on the ball 40 may cause the spring 70 to compress thus preventing the ball 40 from further hindering or stopping the heel cover 50 from sliding into the desired position. Once the desired position is achieved, the ball 40 may matingly engage with the opening 60 and the spring 70 may expand thus pushing the ball 40 into and against the opening 60. Force, in excess of that required for sliding the heel cover 50 along the polygonal shoe post 20, may be required in order to force the ball 40 into compressing the spring 70 and thus enabling the heel cover 50 to slide along the polygonal shoe post 20. In addition to force, a button or other triggering device may be used to compress the spring 70. Those skilled in the art will appreciate that any number of different devices may be used so that the heel cover 50 may matingly engage the main body 30.

The shoe 90 may have a threaded passageway 91 located within a shoe bottom. The threaded passageway 91 may be configured to receive a male threaded upper end 33 located on the main body 30. The male threaded upper end 33 may be located near the top end 31 of the main body 30.

Those skilled in the art will further appreciate that the polygonal shoe post 20 may have a male threaded upper end 33 that may threadably engage a threaded female passageway 91 located in the bottom portion of the shoe 90. Similarly, the shoe 90 may include a male threaded member 92 that extends downwardly from a bottom portion of the shoe 90 that may engage a threaded female passageway 34 formed in an upper portion of the polygonal shoe post 20. In one embodiment, a user may attach the polygonal shoe post 20 to the bottom of the shoe 90 by screwing a male threaded upper end 33 located at the top 31 of the polygonal shoe post 20 into the threaded female passageway 91 on the bottom portion of the shoe 90.

Attaching the polygonal shoe post 20 to the shoe 90 bottom by way of screw has multiple beneficial effects. It not only provides a secure attachment for the polygonal shoe post 20 to the bottom of the shoe 90, but allows a user to orient the polygonal shoe post 20 in different manners. This allows the heel cover 50 to be displayed in different orientations when slid overtop the polygonal shoe post 20. By way of non-limiting example, a user utilizing a rectangular shaped heel cover 50 may screw the polygonal shoe post 20 so that a planar surface is facing the rear of the shoe. Assuming the outside of the heel cover 50 was also rectangular, a planar surface of the heel cover 50 slid overtop of the polygonal shoe post 20 would be facing the rear as well. If the user wanted to change the look of a single heel cover 50, the user could turn the polygonal shoe post 20 one-half rotation so that an angled edge would be facing the rear. The result of the one-half rotation would cause the heel cover 50 edge to be facing the rear thereby giving the heel cover 50 a diamond shaped appearance instead of a square or rectangular appearance.

The polygonal shoe post 20, the main body 30, the ball 40, or the heel cover 50 may be metallic, wooden, plastic, fabric, rubber, a composite, a combination of materials or other material known in the art. Those skilled in the art will appreciate that the shoe may be any size or any number of sizes. The shoe heel cover and kit 10 may also be any size as desired. The polygonal shoe post 20, the main body 30, the ball, or the heel cover 50, may be a strong rigid material. The polygonal shoe post 20, for example may be any length and thickness or diameter desired. For example, and without limitation, the polygonal shoe post 20 may be approximately three inches high, i.e., from bottom of the polygonal shoe post 20 to the heel of the shoe, and may be approximately ⅓ inch in diameter. Also for example, and without limitation, the polygonal shoe post 20 may increase in diameter (or circumference or perimeter, depending on shape) from the second end 32 to the first end 31. The polygonal shoe post 20 may be cylindrical or ovular, have a cross section that is polygonal, or any combination thereof. Those skilled in the art will appreciate that the polygonal shoe post 20, heel cover 50, and/or polygonal void 51 may be any number of sizes and shapes.

Figure 5:
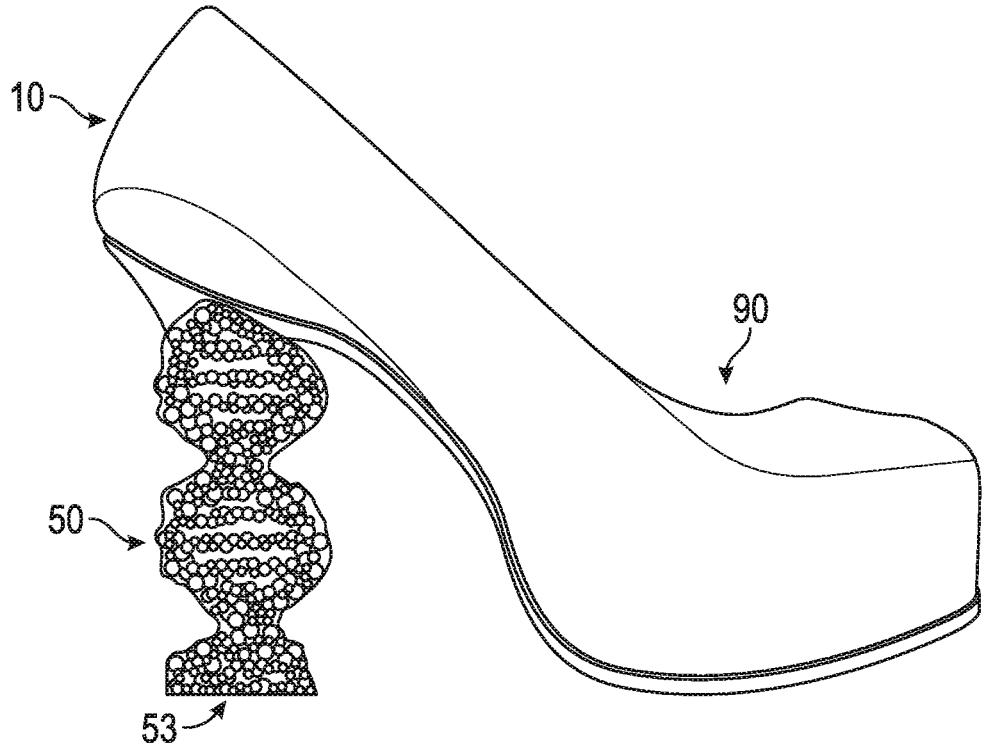
FIG. 5 is a side view of a shoe system having a shoe, a shoe post, and a heel cover according to another embodiment of the present invention.
Figure 6:
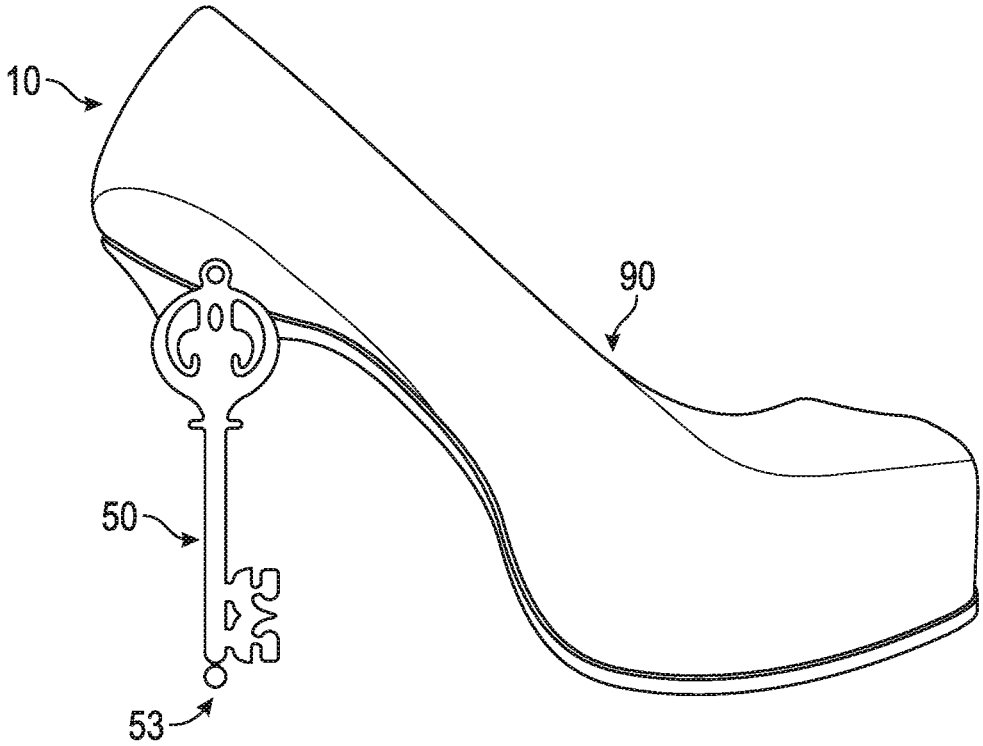
FIG. 6 is a side view of a shoe system having a shoe, a shoe post, and a heel cover according to another embodiment of the present invention.
Figure 7:
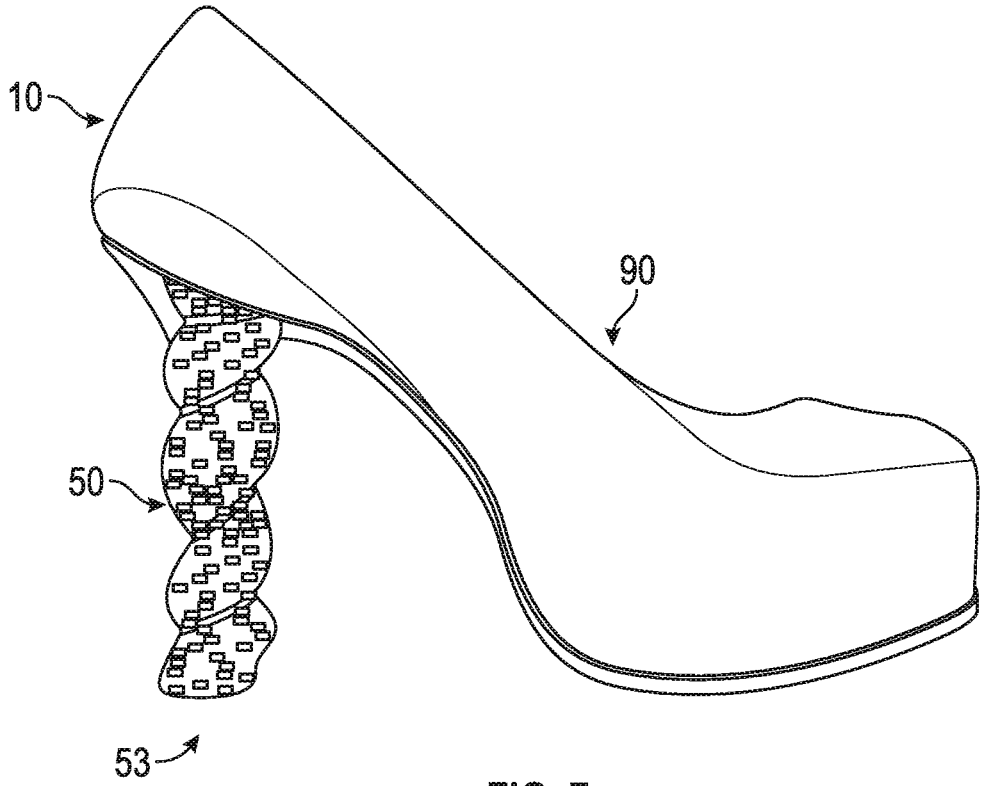
FIG. 7 is a side view of a shoe system having a shoe, a shoe post, and a heel cover according to another embodiment of the present invention.
Figure 8:
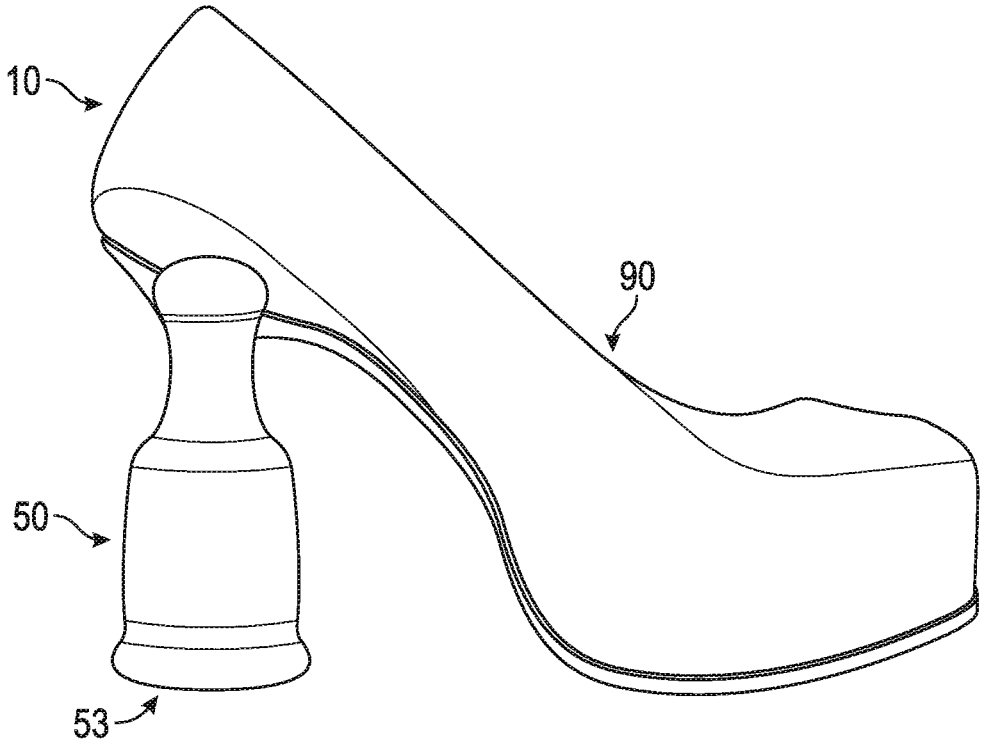
FIG. 8 is a side view of a shoe system having a shoe, a shoe post and a heel cover according to another embodiment of the present invention.
Figure 9:
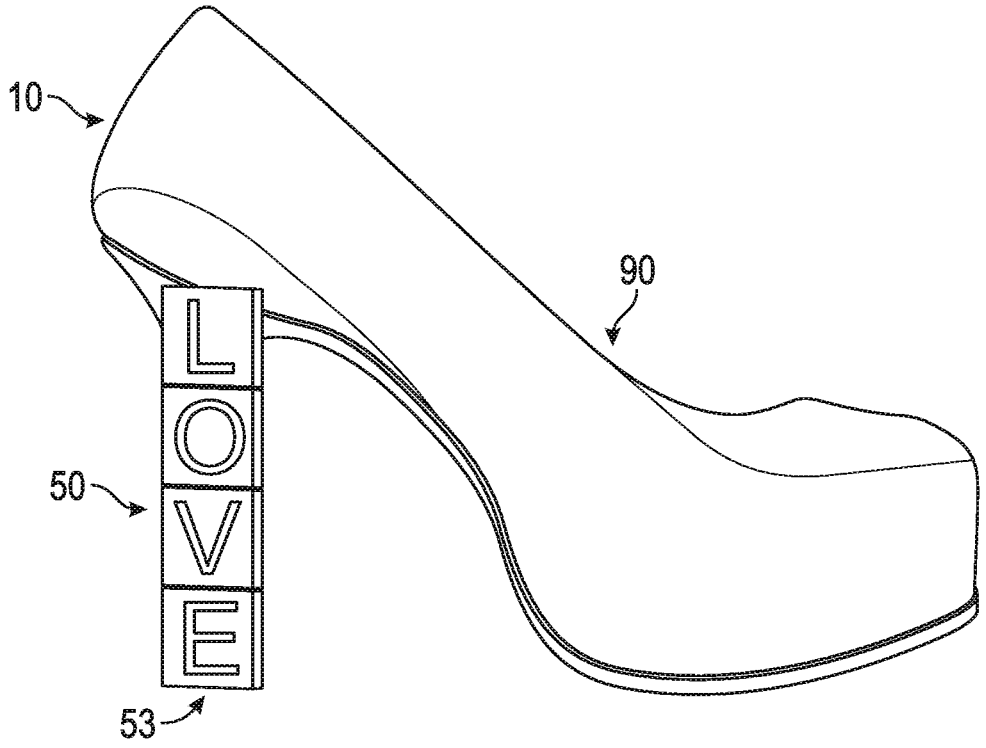
FIG. 9 is a side view of a shoe system having a shoe, a shoe post, and a heel cover according to another embodiment of the present invention.
Figure 10:
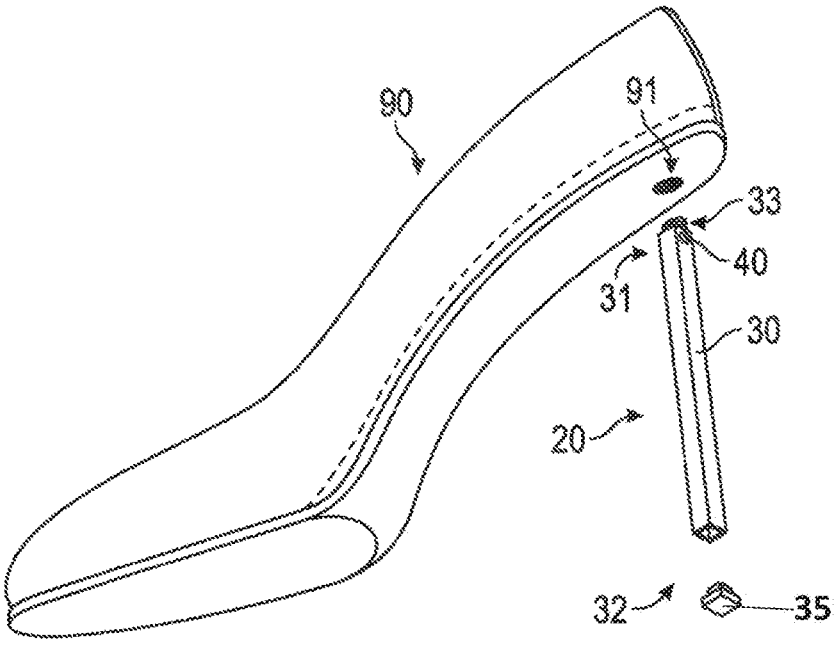
FIG. 10 is a side perspective view of a shoe system having a shoe post according to yet another embodiment of the present invention.
Figure 11:
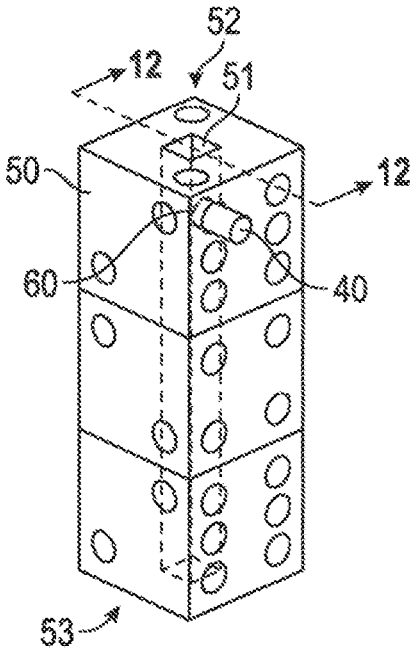
FIG. 11 is a top perspective view of a shoe heel cover according to an embodiment of the present invention.
Figure 12:
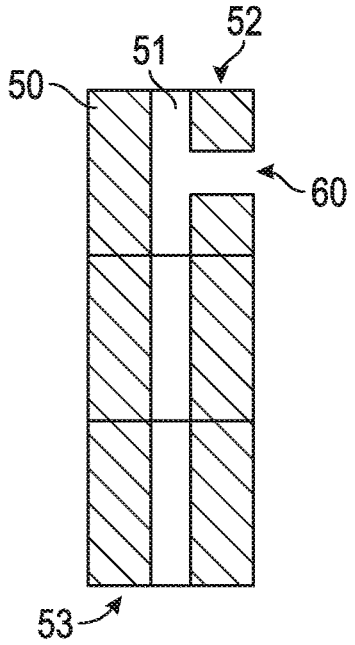
FIG. 12 is a cross-section view taken through line 12-12 in FIG. 11.
Figure 13:
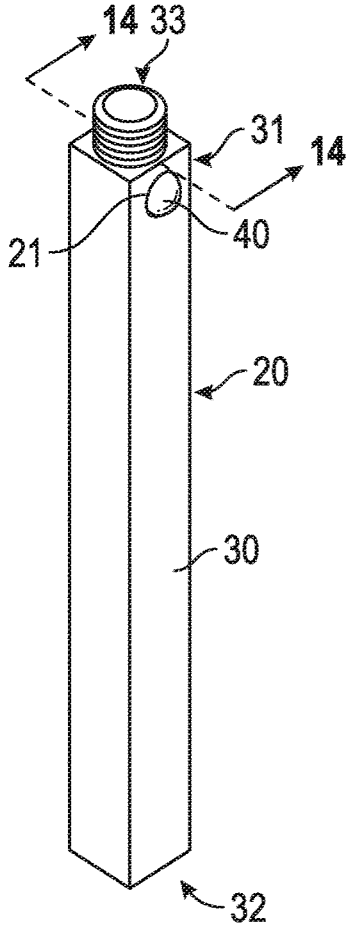
FIG. 13 is a top perspective view of the shoe post according to an embodiment of the present invention.
Figure 14:
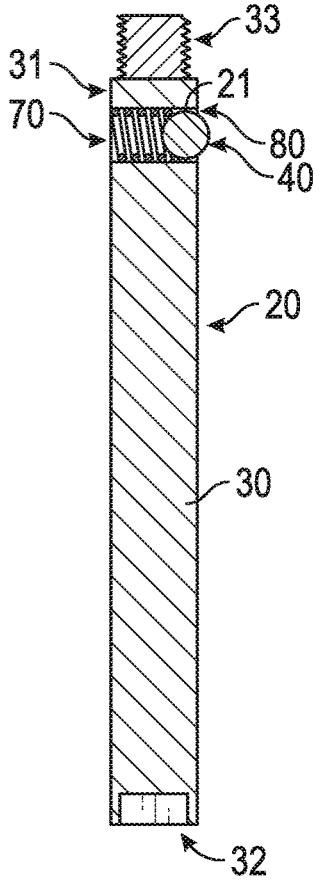
FIG. 14 is a cross-section view taken through line 14-14 in FIG. 13.
Figure 15:
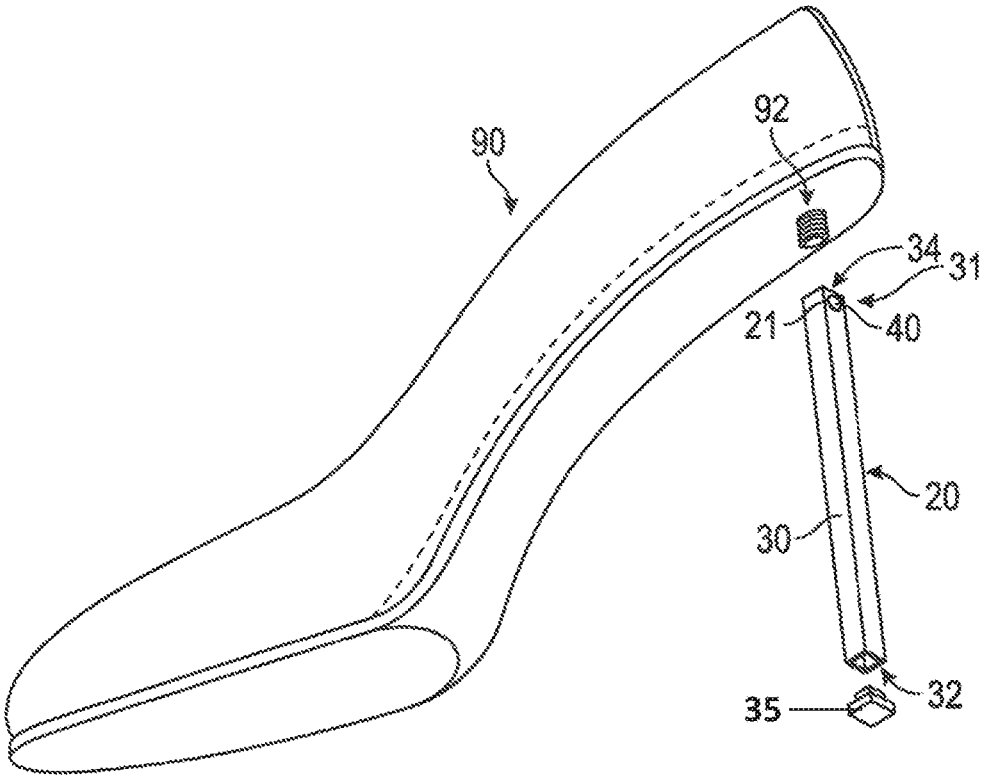
FIG. 15 is a side perspective view of a shoe system having a shoe post according to yet another embodiment of the present invention.
Figure 16:
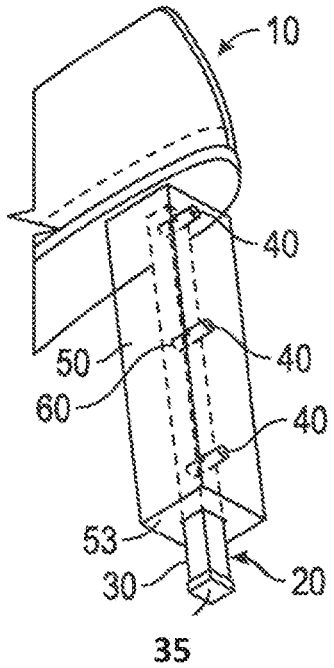
FIG. 16 is a partial side perspective view of the shoe system according to an embodiment of the present invention.
Figure 17:
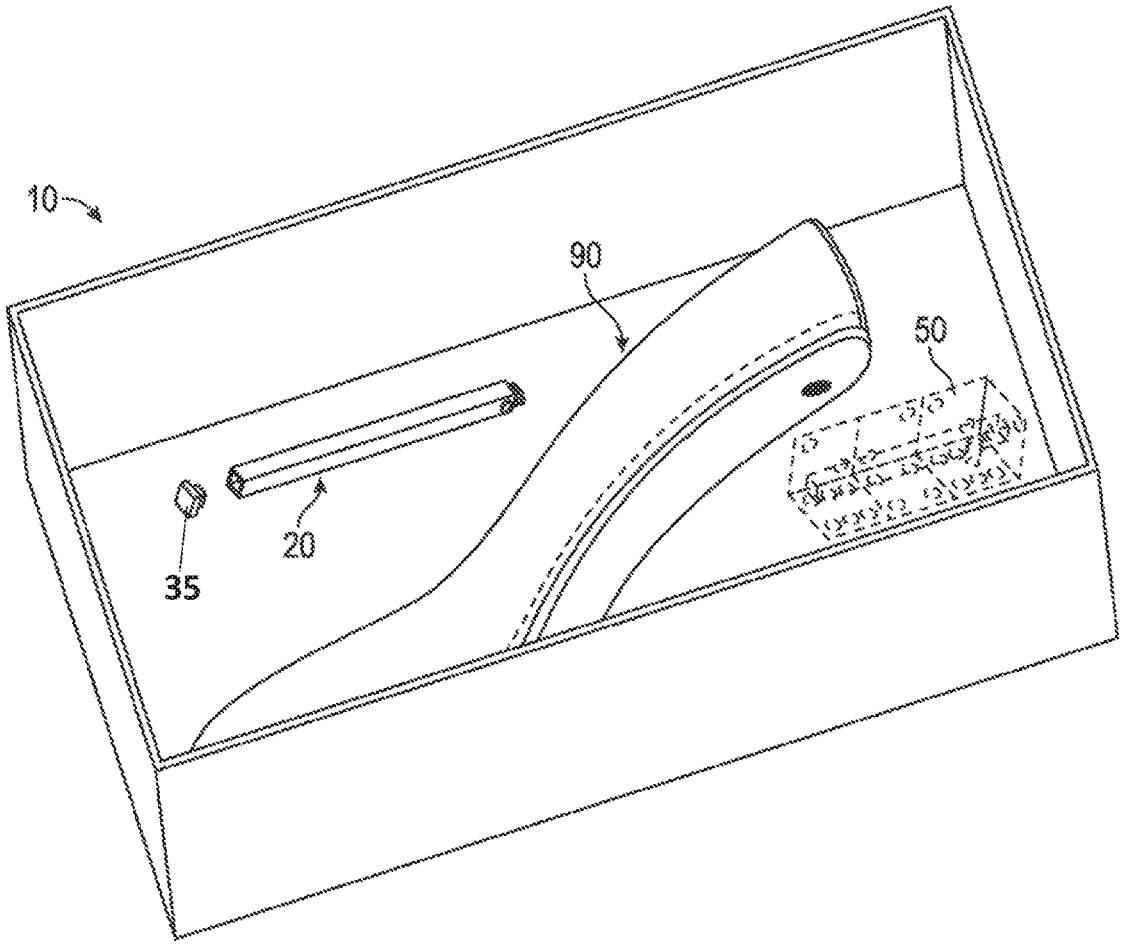
FIG. 17 is a top perspective view

Referring now to FIGS. 2 and 4-9, the heel cover 50 may be provided by a variety of different shapes and sizes and may include a multitude of decorative features. For example, and without limitation, in FIGS. 2 and 4, the heel cover 50 is illustrated as three dice. In FIG. 5, the heel cover 50 is illustrated as a DNA helix. In FIG. 6, the heel cover 50 is illustrated as a key. In FIG. 7, the heel cover 50 is illustrated as a stack of poker chips. In FIG. 8, the heel cover 50 is illustrated as a trophy. In FIG. 9, the heel cover 50 is illustrated as a combination of letters, such as L, O, V, and E. Those skilled in the art will appreciate that the foregoing included a list of examples and is not meant to be limiting in any way of the type of heel cover 50 that may be provided and that may be contemplated by the present invention, and that any number of heel covers 50 may be interchangeable and any number of designs, decorations, sizes, and shapes may be used.

Those skilled in the art will appreciate that the polygonal shoe post 20 may be interchangeable. The heel cover 50 may still slide over the polygonal shoe post 20 and may matingly engage the ball 40. The polygonal shoe post 20 may also include a heel cap 35. The heel cap 35 may include the ball 40 or other device as described herein for allowing the heel cover 50 to matingly engage the polygonal shoe post 20.

Those skilled in the art will appreciate that placing the ball 40 on the polygonal shoe post 20 has many advantages. For example, if the ball 40 were placed on the inside sole of the shoe, a user may be bothered by the protrusion when taking a step or placing weight on the shoe. Furthermore, a user may intentionally disengage the button if a user compressed the protruding button when taking a step.

Some of the illustrative aspects of the present invention may be advantageous in solving the problems herein described and other problems not discussed which are discoverable by a skilled artisan.

While the above description contains much specificity, these aspects of the invention should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the description of the invention. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

That which is claimed is:

1. A shoe heel and heel cover system comprising:

a shoe post comprising:

a polygonal main body having a top and a bottom, the top being configured to be secured to a shoe, an aperture located in the polygonal main body adjacent the top, a ball located in the aperture on the polygonal main body, a spring positioned within the aperture of the polygonal main body and behind the ball; and a heel cap positioned at the bottom of the polygonal main body and defining a weight-bearing surface of the shoe;

a plurality of heel covers, each heel cover having a polygonal void formed therethrough, and running the interior length thereof, to slidably engage the shoe post;

each heel cover having an opening therein and positioned within the polygonal void to matingly engage the ball as the heel cover is slidably engaged on the shoe post; and wherein the heel cap is configured to facilitate the shoe post slidably engaging the heel cover so that the heel cap and weight-bearing surface extends below the heel cover;

wherein the polygonal void tapers from a top portion to a bottom portion of the heel cover and is entirely filled with the shoe post when the heel cover and shoe post are matingly engaged with each other;

wherein the ball is moveable between an engaged position and a disengaged position, the disengaged position being defined as the spring being compressed so that the ball is depressed into the aperture of the polygonal main body, and the engaged position being defined as the spring being at rest so that the ball protrudes from the aperture of the polygonal main body;

wherein the ball is configured to align with and matingly engage the opening when the ball and the opening align;

wherein the heel cover and the shoe post are matingly engaged when the ball is positioned within the opening;

wherein the heel cover is configured to disengage and slide off of the shoe post when the ball moves from the engaged position to the disengaged position.

2. The system according to claim 1 wherein when the heel cover slidably engages the shoe post, the heel cover is configured to place force on the ball to move the ball from the engaged position to the disengaged position.

3. The system according to claim 1 wherein the spring is moveable between a compressed position and a decompressed position; wherein the compressed position is defined as the spring being compressed by a force exerted on the ball and moving the ball to the disengaged position; and wherein the decompressed position is defined as the spring being extended to position the ball in the engaged position; wherein the spring is configured to move from the compressed position to the decompressed position.

4. The system according to claim 1 wherein the shoe post further comprises a male threaded upper end configured to be received by a threaded female passageway on a shoe.

5. The system according to claim 1 wherein the shoe post further comprises a plurality of balls located on the polygonal main body configured to matingly engage with a corresponding plurality of openings on the heel cover.

6. The system according to claim 1 wherein the shoe post further comprises a threaded female passageway configured to engage a male threaded member that extends downwardly from a shoe bottom.

7. The system according to claim 1 wherein each heel cover is configured to be removable and interchangeable with each of the plurality of heel covers which define similarly structured heel covers.

8. The system according to claim 7 wherein the plurality of similarly structured heel covers are uniquely decorated.

9. A shoe heel comprising:

a polygonally shaped shoe heel post comprising
a main body having a top to be secured to a shoe;
an aperture within the main body adjacent the top;
a ball and spring in the aperture of the main body; and
a heel cap positioned at a bottom of the main body and defining a weight-bearing surface of the shoe; and a removeable elongate heel cover with an opening configured to matingly engage the shoe heel post ball;

wherein the removable elongate heel cover comprises a longitudinal polygonal void running the interior length thereof and sized to receive the polygonally shaped shoe heel post;

wherein the elongate heel cover is configured to secure to the polygonally shaped shoe heel post via the ball and spring;

wherein the heel cap is configured to facilitate the shoe heel post slidably engaging the removable elongate heel cover so that the heel cap and weight-bearing surface extends below the removable elongate heel cover;

wherein the polygonal void tapers from a top portion to a bottom portion of the elongate heel cover and is entirely filled with the shoe heel post when the elongate heel cover and shoe heel post are matingly engaged with each other;

wherein the ball is moveable between an engaged position and a disengaged position, the disengaged position is defined as the spring being compressed so that the ball is depressed into the aperture of the polygonal main body, and the engaged position is defined as the spring being at rest so that the ball protrudes from the aperture of the polygonal main body;

wherein the ball is configured to align with and matingly engage the opening when the ball and the opening align;

wherein the elongate heel cover and the shoe heel post are matingly engaged when the ball is positioned within the opening; and wherein the elongate heel cover is configured to disengage and slide off of the shoe post when the ball moves from the engaged position to the disengaged position.

10. The shoe heel cover according to claim 9 wherein slidably engaging the polygonally shaped void on the elongate member with the polygonally shaped shoe heel post causes the ball to be moved from the engaged position to the disengaged position.

11. The shoe heel cover according to claim 10 wherein the ball is configured to move from the disengaged position to the engaged position when aligned with the opening of the shoe heel cover and wherein the ball is adapted to secure the elongate member to the polygonally shaped shoe heel post with a friction fit when in the engaged position.

12. The shoe heel cover according to claim 11 wherein the polygonally shaped shoe heel post has a male threaded upper end adapted to be received by a threaded female passageway located on a shoe bottom.

13. The shoe heel cover according to claim 12 wherein the polygonally shaped shoe heel post is configured to rotate from a first position relative to the shoe bottom and settle into a different aesthetic orientation in a second position.

14. The shoe heel cover according to claim 13 wherein the shoe heel cover is configured to rotate with the polygonally shaped shoe heel post from a first position relative to the shoe bottom and settle into a different aesthetic orientation in a second position.

15. A heel cover kit comprising:

a shoe having a threaded passageway located within a shoe bottom, wherein the threaded passageway is configured to receive a male threaded upper end;

a shoe heel post including a main body that has a polygonal shape and comprising:
a top, an opposing bottom, and a plurality of planar surfaces there between, wherein the male threaded upper end extends from the top for securing the shoe heel post to the shoe,
a recess located in at least one of the plurality of planar surfaces adjacent the top,
a spring within the recess,
a ball that is moveable between an engaged position and a disengaged position, the disengaged position being defined as the ball being depressed against the spring into the recess of the main body; and the engaged position being defined as the ball protruding via a force of the spring from the recess of main body; and
a heel cap positioned at the bottom of the main body and defining a weight-bearing surface for the shoe;

an elongate heel cover having a longitudinal polygonal void running the interior length thereof and that is adapted to receive the shoe heel post, and having an opening therein configured to matingly receive the ball;

wherein the heel cap is configured to facilitate the shoe heel post slidably engaging the heel cover so that the heel cap and weight-bearing surface extends below the heel cover;

wherein the opening and the ball are configured to align and secure the heel cover to the shoe heel post with a friction fit; and wherein the heel cover is configured to be removable and interchangeable with a plurality of similarly structured heel covers;

wherein the heel cover and the shoe heel post are matingly engaged when the ball is positioned within the opening;

wherein the polygonal void tapers from a top portion to a bottom portion of the heel cover and is entirely filled with the shoe heel post when the heel cover and shoe heel post are matingly engaged with each other; and wherein the heel cover is configured to disengage and slide off of the shoe post when the ball moves from the engaged position to the disengaged position.

* * * * *